US006026769A

United States Patent [19]

Anbarasu et al.

[11] Patent Number: 6,026,769

[45] Date of Patent: Feb. 22, 2000

[54] MECHANICAL DIRECT CYLINDER FUEL INJECTION

[75] Inventors: Muniappan Anbarasu, Flint; William E. Galka, Caro; Martin L. Radue; Ronald H. Roche, both of Cass City; Kevin L. Williams, Columbiaville; Charles H. Tuckey, Cass City; J. D. Tuckey, deceased, late of Cass City, all of Mich., by Dolores Tuckey, executrix and trustee

[73] Assignee: Walbro Corporation, Cass City, Mich.

[21] Appl. No.: 08/865,787

[22] Filed: May 29, 1997

[51] Int. Cl.[7] ..... F02B 33/22

[52] U.S. Cl. ..... 123/70 R; 123/70 V

[58] Field of Search ..... 123/70 R, 70 V

[56] References Cited

U.S. PATENT DOCUMENTS

| | | | |
|---|---|---|---|
| 1,197,951 | 9/1916 | Pieper | 123/70 R |
| 1,266,954 | 5/1918 | Kirk | 123/70 R |
| 1,344,263 | 6/1920 | Crouse | 123/70 R |
| 1,596,398 | 8/1926 | Burtnett | 123/70 R |
| 1,609,792 | 12/1926 | Brock | 123/70 R |
| 1,686,789 | 10/1928 | Belden | 123/70 V |
| 1,988,082 | 1/1935 | Latta | 123/70 V |
| 2,058,705 | 10/1936 | Maniscalco | 123/70 V |
| 2,776,650 | 1/1957 | Zimmermann | 123/70 V |
| 3,265,050 | 8/1966 | Tuckey | 123/437 |
| 3,774,581 | 11/1973 | Lundy | 123/70 R |
| 4,271,093 | 6/1981 | Kobayashi | 261/34.1 |
| 4,781,155 | 11/1988 | Brucker | 123/70 V |
| 5,007,384 | 4/1991 | Blair | 123/70 R |
| 5,033,418 | 7/1991 | Maissant et al. | 123/70 V |
| 5,271,372 | 12/1993 | Nuti | 123/533 |
| 5,275,134 | 1/1994 | Springer | 123/70 R |

*Primary Examiner*—David A. Okonsky
*Attorney, Agent, or Firm*—Barnes, Kisselle, Raisch, Choate, Whittemore & Hulbert, P.C.

[57] ABSTRACT

A two-stroke internal combustion engine having at least one cylinder with a combustion chamber defined between the cylinder head and a reciprocating piston, and a carburetor which delivers a rich fuel and air mixture to a compressor with a reciprocating piston driven by the engine to compress the mixture until the mixture is under sufficient pressure to open a differential pressure injection valve and thereby inject the mixture directly into the engine combustion chamber. The mixture is ignited by a spark plug to drive the engine piston through its power stroke and rotate its associated crankshaft which is connected to a crankshaft of the compressor to reciprocate its piston and thereby compress the fuel and air mixture and inject it into the cylinder in timed relation with the engine piston.

29 Claims, 7 Drawing Sheets

MECHANICAL DIRECT CYLINDER FUEL INJECTION

FIELD OF THE INVENTION

This invention relates generally to internal combustion engines and more particularly to a two-stroke internal combustion engine with direct cylinder fuel injection.

BACKGROUND OF THE INVENTION

Two-stroke internal combustion engines are used for a variety of applications despite their relatively high fuel consumption and exhaust gas emission rates. As concern for the environment increases, government regulations have been and are being promulgated requiring reduced emissions and improved fuel economy from two stroke internal combustion engines.

One method used to lower the emissions and fuel consumption of four stroke internal combustion engines has been the adaptation of electronically controlled and electromagnetically actuated fuel injectors as opposed to carburetors to provide fuel to the engine. These fuel injectors can be precisely timed to deliver metered quantities of fuel to the engine at the appropriate times to reduce emissions and fuel consumption and have therefore been widely used. However, the electronic control unit, sensors and fuel injectors add considerable cost and complexity to the system and are too expensive and impractical for many small engines systems which do not have a battery or generator to power and control the electronic fuel injection systems.

Another approach to lowering the fuel consumption and emission rates of internal combustion engines is by direct injection of the fuel into the engine cylinder as opposed to an intake manifold of the engine which allows better timing of the injection to reduce fuel losses in the exhaust scavenge gas thereby reducing hydrocarbon exhaust emissions and decreasing the fuel consumption of the engine.

In some proposed systems, as in U.S. Pat. No. 5,271,372, a fuel injector delivers fuel, usually at a relatively low pressure, to a compression chamber wherein the fuel is mixed with air creating a pressurized mixture which is injected directly into the cylinder of the engine. While these systems can be effective at reducing fuel consumption and emissions from the engine, they are relatively expensive due to the fuel injector and the overall complexity of the fuel injection systems and also increase the size of the engine as the compression chamber is located on top of the cylinder head with the fuel injector mounted adjacent to the compression chamber. This is undesirable for small engines such as those used in lawn and garden equipment, boat motors and small motorcycle engines where a compact and inexpensive engine is required.

SUMMARY OF THE INVENTION

For a two-stroke internal combustion engine having at least one cylinder with a combustion chamber defined between a cylinder head and a reciprocating piston, a carburetor delivers a rich fuel and air mixture to a compressor which has a reciprocating piston driven by the engine crankshaft to compress the mixture to a sufficient pressure to open a differential pressure injection valve and thereby inject the mixture directly into the combustion chamber of the engine cylinder. This mixture, when combined with air in the engine cylinder, is ignited by a spark plug to drive the engine piston through its power stroke and rotate its associated crankshaft which is coupled to the compressor crankshaft to operate the compressor and thereby compress the fuel and air mixture and inject it into the engine cylinder. Preferably, the compressor also creates sub-atmospheric conditions to actuate the carburetor to produce the rich fuel and mixture supplied to the compressor.

The compressor is driven in timed relation to each engine piston to cause a portion of the rich fuel and air mixture to be injected into the combustion chamber of each cylinder during substantially the same portion of each cycle of each piston. Preferably, the injection into each combustion chamber is timed so that fuel mixture losses in the exhaust scavenge gas are minimal to reduce hydrocarbon exhaust emission and also to reduce fuel consumption of the engine. Preferably, each engine cylinder has a transfer port communicating with the engine crankcase to provide additional fresh air in the combustion chamber which combines with the rich fuel and air mixture injected into the cylinder to provide the desired fuel to air ratio and a more uniformly combustible mixture in the chamber to improve combustion of the fuel and performance of the engine. Air flow into both the engine crankcase and the carburetor may be controlled by synchronized throttle valves.

The compressor can be exteriorly mounted and spaced from the main cylinder providing a compact engine and also reducing heat transfer between the cylinder and compressor. Preferably, a flexible fluid conduit communicates the compressor with the combustion chamber and has a pressure controlled valve located at the combustion chamber to prevent flow of the mixture through the fluid conduit until the mixture is under sufficient pressure above the combustion chamber to force the valve open. Preferably, a pair of valves are disposed in the fluid flow path with one valve adjacent the compressor to control compression of the fuel and air mixture and one valve adjacent the combustion chamber to control injection of the mixture into the combustion chamber. Preferably, the valve adjacent the combustion chamber has a valve head that is tapered and has a radially expanding or diverging shape to improve dispersion of the mixture into the combustion chamber.

Objects, features and advantages of this invention include providing an engine with a rich fuel and air mixture mechanically injected directly into each combustion chamber of the engine, improved combustion within each combustion chamber, a precisely controlled injection driven by the movement of each engine piston, reduced fuel consumption, reduced exhaust emissions, simple adjustment of fuel injection timing, improved injection timing to reduce introduction of fuel into cylinder exhaust scavenge gas, which utilizes crankcase air flow controlled by a main throttle valve to provide the primary source of inducted air for combustion in the combustion chamber, can be adapted to various existing engine designs with minimal modifications, improves run quality and starting of the engine, is compact, relatively inexpensive, of relatively simple design and economical manufacture, readily adaptable to a wide range of engine applications, durable, requires little maintenance and has in-service a long useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
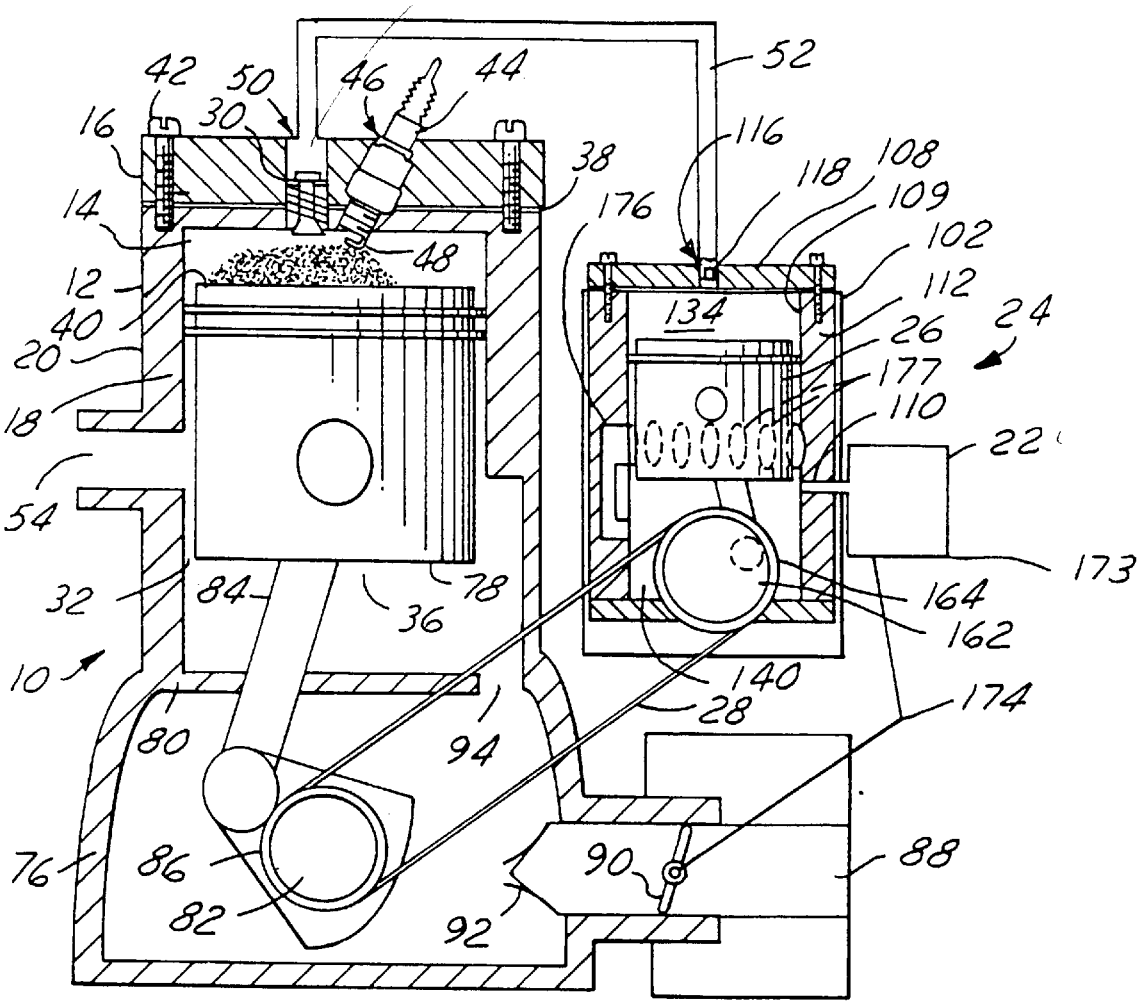
FIG. 1 is a semi-diagrammatic view of a two-stroke internal combustion engine embodying this invention.

FIG. 1 illustrates a two-stroke internal combustion engine 10 embodying this invention and having a cylinder 12 with a combustion chamber 14 defined between a cylinder head 16 and a reciprocating piston 18 within the cylinder body 20. A carburetor 22 delivers a rich fuel and air mixture to a compressor 24 which has a reciprocating piston 26 driven through a timing belt or chain 28 in timed relation with the engine piston 18 to compress the rich fuel and air mixture and deliver it under sufficient pressure to a differential pressure injection valve 30 in the cylinder head 16 which, when open, permits the rich fuel and air mixture to be injected into the combustion chamber 14 of the cylinder 12. The compressor 24 is preferably mounted at a location spaced from the engine 10 to provide a more compact engine 10 which is readily adaptable to many different engine applications. This also thermally isolates the compressor from heat transfer from the combustion chamber, cylinder body and cylinder head.

The engine cylinder 12 has a central bore 32 constructed to slidably receive a piston 18 for linear reciprocation between first and second positions in the cylinder 12, generally known as top dead center 34 and bottom dead center 36. As shown, the cylinder head 16 is secured adjacent the upper edge 38 of the cylinder body 20 by several cap screws 42. The cylinder head 16 and cylinder body 20 may be joined in other ways such as by integrally forming them in a one-piece casting. A spark plug 44 extends through an opening 46 in the cylinder head 16 and into the combustion chamber 14 defined by the upper face 40 of the piston 18, the cylinder body 20 and cylinder head 16. The spark plug 44 is preferably canted at an acute included angle to have its ignition end 48 disposed generally adjacent the center of the cylinder head 16.

The cylinder head 16 has another opening 50 therethrough constructed to receive a fluid conduit 52 through which the rich fuel and air mixture is delivered to the combustion chamber 14. The fluid conduit 52 is preferably a metal or polymeric tube, such as a nylon tube, with an internal diameter of about between 0.050 inch to 0.250 inch. To reduce fuel losses to the exhaust scavenge gas and to improve ignition and combustion of the fuel, this opening 50 and its associated fluid conduit 52 are preferably centrally located in the cylinder head 16 and disposed substantially transversely to the upper face 40 of the piston 18 so that the injected fuel flows transversely to the adjacent piston face 40 and generally towards the center of the engine cylinder 12. Preferably, the differential pressure injection valve is inclined no more than 45° from the axis of the piston. Directing the flow onto the piston face 40 enhances fuel vaporization and creates a turbulent flow within the combustion chamber 14 which tends to mix the fuel and air mixture with air in the combustion chamber 14, reduces fuel loss to the exhaust scavenge gas, and decreases the average operating temperature of the piston. The injected mixture is further prepared and mixed when it is compressed by the piston 18 prior to ignition. To allow exhaust gases to flow out of the combustion chamber 14 after combustion, at least one exhaust port 54 is located through the side wall of the engine cylinder 12 and is selectively communicated with the exterior of the engine cylinder 12 by the piston 18.

Figure 2:
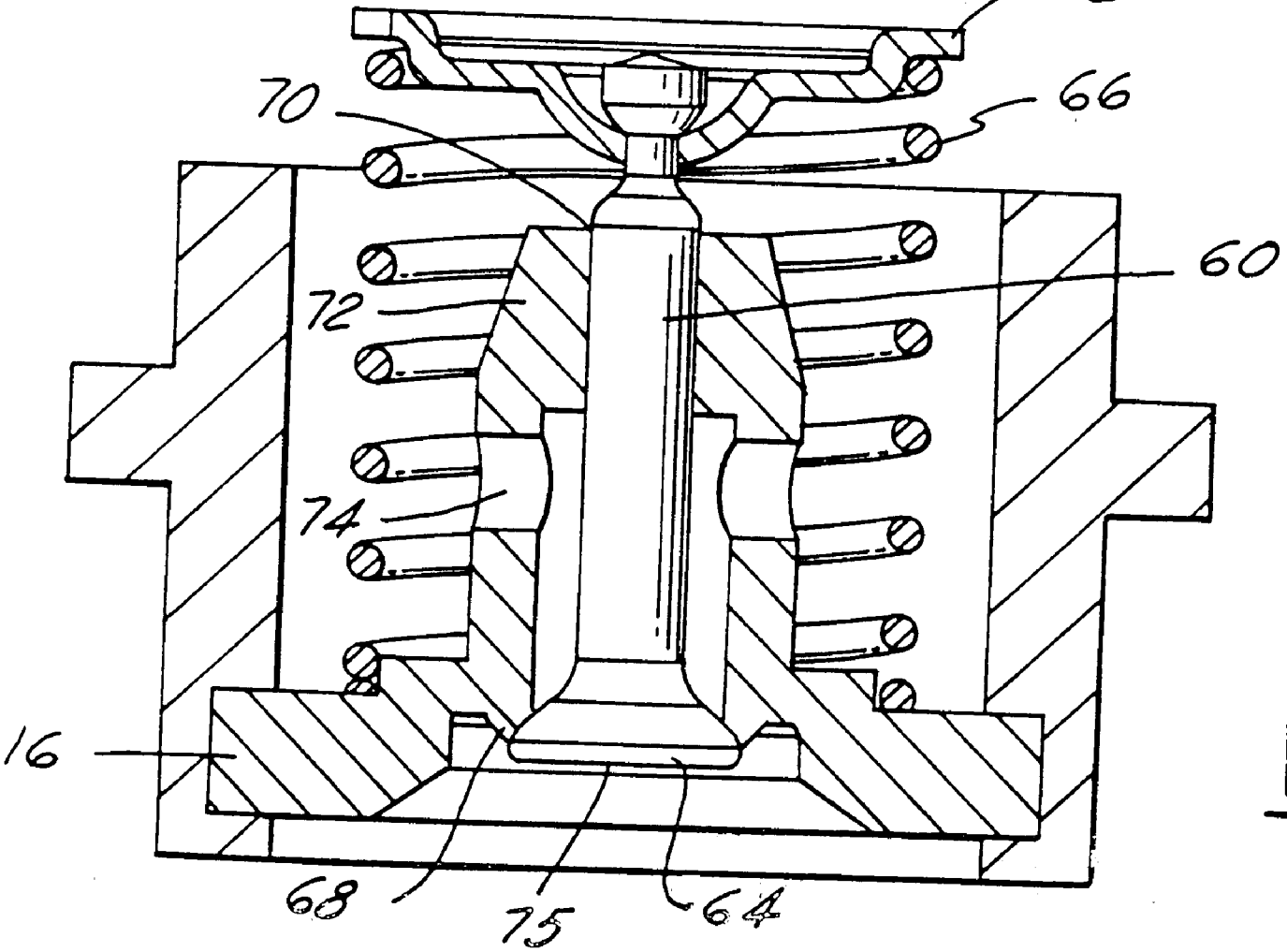
FIG. 2 is a perspective view of a differential pressure injection valve.

Preferably, the differential pressure injection valve 30 is disposed adjacent the cylinder head 16 and selectively communicates the fluid conduit 52 and the combustion chamber 14. As shown in FIG. 2, the differential pressure injection valve 30 has a valve stem 60 received in an annular retainer 62 adjacent one end and preferably a frusto conical valve head 64 adjacent its other end to promote dispersion of the fuel and air mixture that flows through the valve 30. A spring 66 engages the retainer 62 to bias the valve 30 to a closed position with the valve head 64 firmly engaging a valve seat 68 of the cylinder head 16 thereby preventing fuel flow into the combustion chamber 14. The valve stem 60 is preferably slidably received for reciprocation in a central hole 70 of a guide body 72 which has circumferentially spaced ports 74 through which fuel flows.

The forces acting on the valve 30 to open and close it are the spring force, the pressure within the combustion chamber 14 and the pressure within the fluid conduit 52. Optimum valve lift or displacement of the valve head 64 from the valve seat 68 for maximum mixture flow is dependent upon the valve head 64 diameter, spring and mass constants and the pressure differential across the injector valve 30. Nominal values for the valve 30 lift are from about between 0.05 inches to 0.24 inches depending on the design of the differential pressure injection valve 30. The diameter of the differential pressure injector valve face 75 is constrained to about between 0.2 inch to about 0.75 inch for maintaining effective flow velocities and transfer of a sufficient quantity of the fuel and air mixture through the differential pressure injection valve 30. One mathematical formula used for calculation of the differential pressure injection valve 30 diameter, denoted $D_v$, is: 0.20 Bore Dia$<D_v<$0.35 Bore Dia, where Bore Dia is the internal diameter of the engine cylinder 12.

The pressure of the fuel and air mixture adjacent the differential pressure injection valve 30 can vary between 30 psi to 160 psi depending upon the design of the compressor 24, the speed of the compressor 24 and the throttle position of the carburetor 22. At pressures less than 30 psi the mixture velocity is too low resulting in fuel particle coalescence and loss of mixture atomization. Injection pressures greater than 160 psi significantly impact the stability of the fuel and air mixture flow resulting in a reduced fuel and air mixture flow. Higher injection pressures also require increased compressor 24 work which absorbs additional power from the engine 10. A low engine cylinder 12 pressure provides the highest differential pressure for injection of the fuel and air mixture into the engine cylinder 12 with mixture velocities found to be as high as 600 ft/s. Higher engine cylinder 12 pressures lower the overall differential pressure for injection of the mixture. Injection velocities of the fuel and air mixture into the engine cylinder 12 below about 115 ft/s, can severely impact both the flow of the mixture and its atomization quality.

A crankcase 76 is defined between the side 78 of the piston 18 opposite the combustion chamber 14, the cylinder body 20 and a lower wall 80 of the cylinder body 20. The crankcase 76 houses a crankshaft 82 which is powered to rotate by reciprocation of the piston 18 through a connecting rod 84 pivotally connected to the piston 18 at one end and eccentrically connected adjacent the crankshaft 82 at its other end. A cog pulley 86 is operably connected to the crankshaft 82 for co-rotation therewith and is constructed to receive and drive the power transmission member 28 such as a timing belt or chain. To allow air flow into the crankcase 76, an air inlet 88 is provided in a side wall of the crankcase 76 and has an engine air intake throttle valve 90 and a rotary valve, rotary disk or reed valve 92, or a piston port configuration therein to selectively permit air flow therethrough. Valve 92 is a check valve that permits inflow to and prohibits outflow from the crankcase 76. To communicate the air in the crankcase 76 with the combustion chamber 14 a transfer port 94 is located in the body 20 of the engine cylinder 12 extending into the crankcase 76 and selectively communicated with the combustion chamber 14 by the piston 18. When the piston 18 moves adjacent its bottom dead center position 36 in the cylinder the transfer port 94 is open to the combustion chamber 14 and air flows from the crankcase 76 into the combustion chamber 14 to provide fresh air to the combustion chamber 14 and to help purge exhaust gases from the combustion chamber 14. Subsequent piston 18 travel away from the bottom dead center position 36 and towards the top dead center position 34 closes the transfer port 94 to prevent air flow therethrough.

Figure 3:
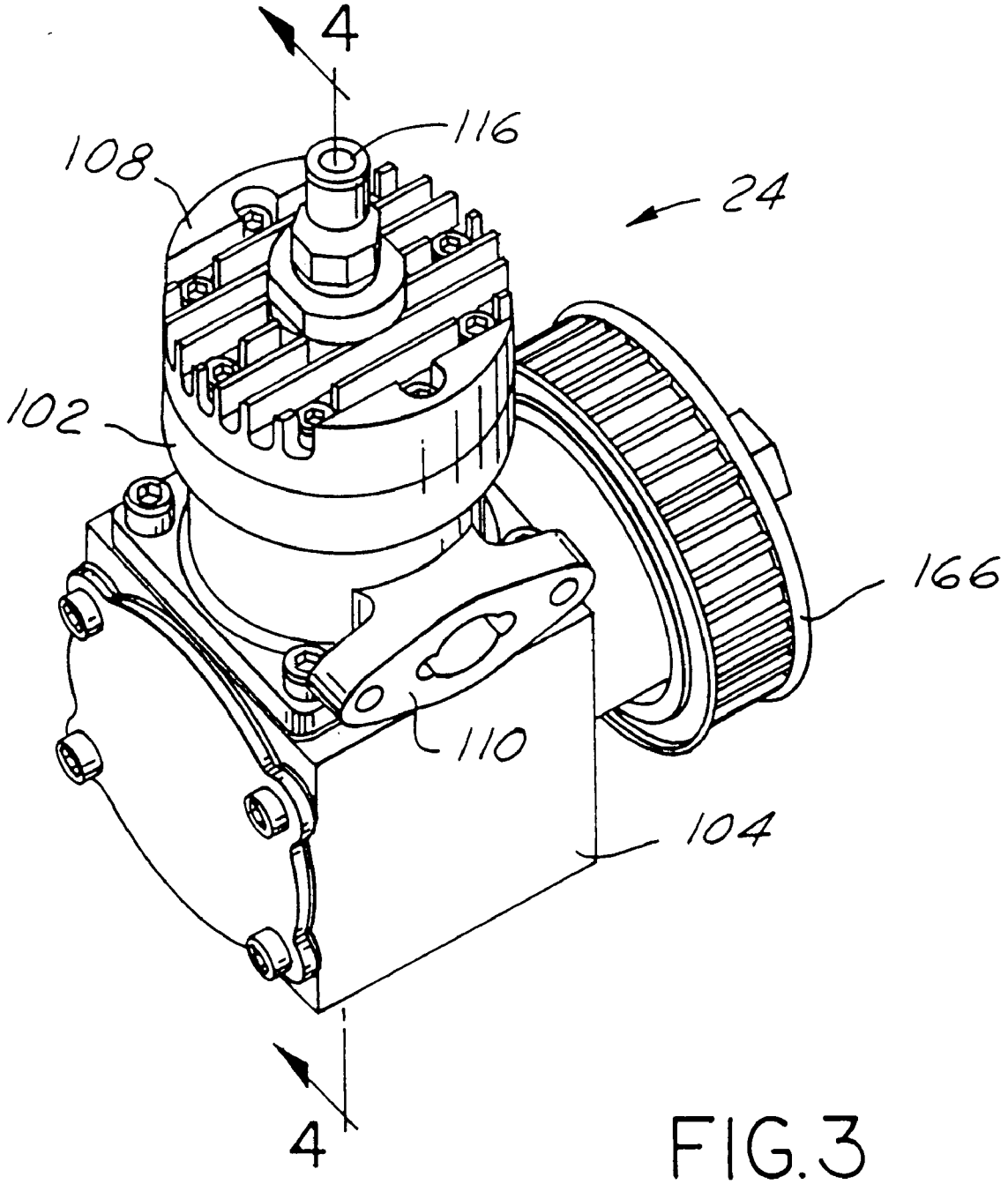
FIG. 3 is a perspective view of a compressor constructed to mechanically compress and deliver a rich fuel and air mixture to the combustion chamber of a cylinder of the engine.
Figure 4:
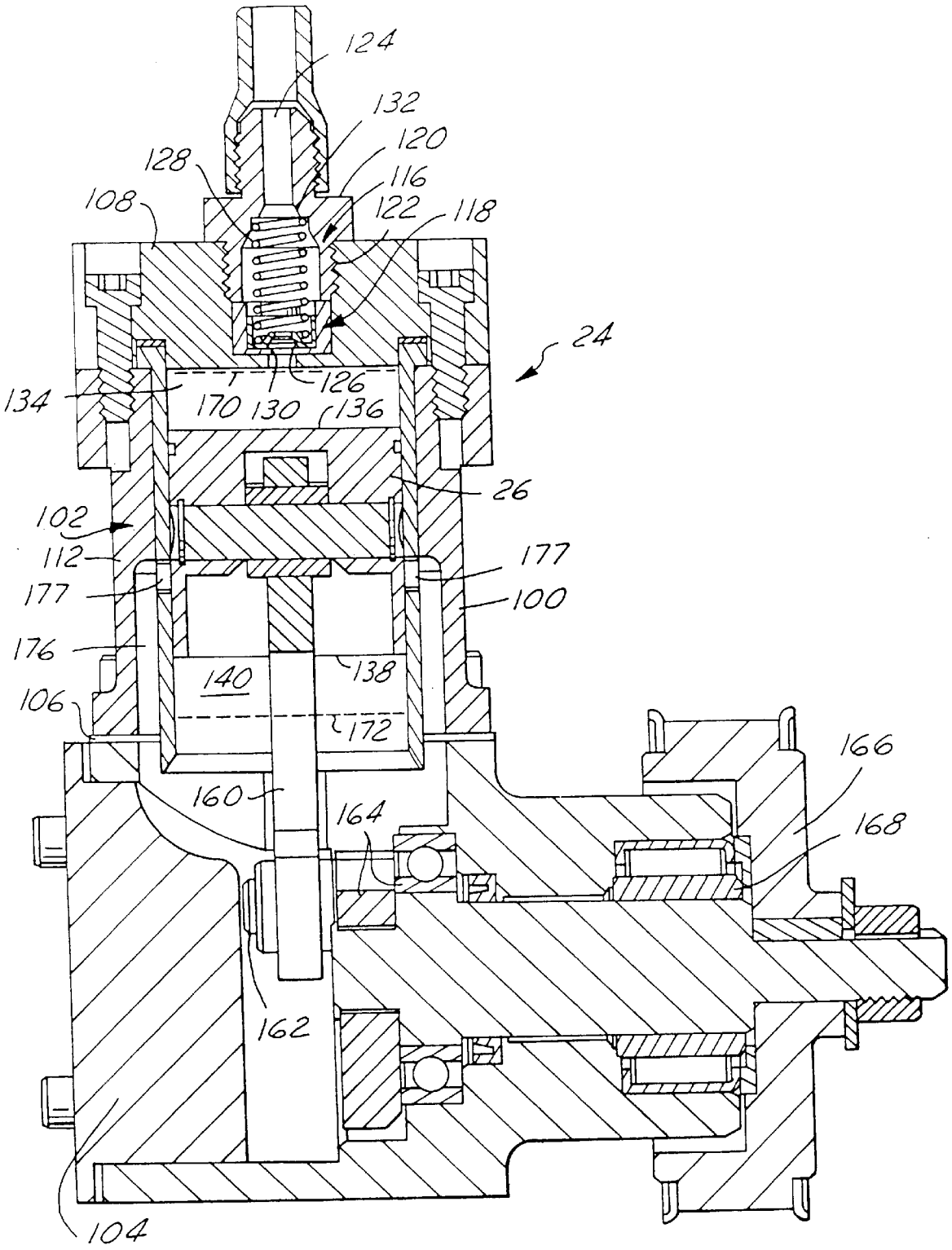
FIG. 4 is a sectional view of the compressor taken along line 4—4 of FIG. 3.

As shown in FIGS. 3 and 4, the compressor 24 comprises a secondary cylinder 100 having a body 102 mounted to a crankcase body 104 with a gasket 106 received between them, a cylinder head 108 and a piston 26 slidably received for reciprocation within a cylindrical bore 109 of the cylinder 100. The compressor 24 may be mounted exteriorly of the engine cylinder 12. A compression chamber 134 is defined between the cylinder head 108, the side wall 112 and the upper face 136 of the piston 26. Adjacent the opposite side 138 of the piston 26, a crankcase chamber 140 is defined with the crankcase body 104, the side wall 112 and the piston 26. An intake port 110 through the side wall 112 of the body 102 constructed to communicate with the outlet 114 of the carburetor 22 and the crankcase chamber 140 to receive the rich fuel and air mixture and deliver it to the crankcase. An outlet 116 is constructed to communicate with the fluid conduit 52 to deliver the fuel and air mixture to the engine cylinder 12.

To control the flow of the fuel and air mixture from the compressor 24 a compression relief valve 118 is disposed within the fluid conduit 52 adjacent to the outlet 116 of the compressor 24 and in communication with the compression chamber 134. The compression relief valve 118 is received in a coupler 120 threadably received in a threaded portion 122 of the compressor 24 adjacent one end and is constructed to telescopically receive the fluid conduit 52 adjacent the other end of the coupler 120. To permit flow of the fuel and air mixture through the coupler 120, it has an opening 124 therethrough which is preferably concentrically aligned with the fluid conduit 52 and with the outlet 116 of the compressor 24. A cup shaped valve head 126 receives one end of a coil spring 128 therein to bias the valve head 126 into engagement with a valve seat 130 to prevent flow of the rich fuel and air mixture through the outlet 116 of the compressor 24. Preferably, to retain the opposite end of the coil spring 128 an annular groove 132 is provided interiorly of the coupler 120. Pressure within the fluid conduit 52 and the force of the spring 128 tend to close the valve 118 while a positive pressure in the cylinder 100 opposes these forces, and opens the valve 118 when greater than these forces.

Thus, the pressure control for the fuel and air mixture pressurization within the compressor 24 and injection into the engine cylinder 12 preferably occurs in two stages. The first stage of pressure control is performed by the compression relief valve 118 at the compressor outlet 116 and the second stage consists of the differential pressure injection valve 30 located within the engine cylinder head 16. This dual stage approach provides improved system response and increased mixture flow through the differential pressure injection valve 30. This is preferably achieved through the use of a heavier or stiffer spring 66 biasing the differential pressure injection valve 30 then the spring 128 biasing the compression relief valve 118. Preferably, the spring 128 biasing the compression relief valve 118 has a spring constant in the range between 10 lbs/in$^2$ and 30 lbs/in$^2$ and more preferably between 12 lbs/in$^2$ and 25 lbs/in$^2$. The spring 66 biasing the differential pressure injection valve 30 preferably has a spring constant in the range of about 70 lb/in$^2$ to 200 lbs/in$^2$ and more preferably between 90 lbs/in$^2$ and 150 lbs/in$^2$. This allows considerable pressure build-up adjacent the differential pressure injection valve 30 to facilitate discharge of the mixture into the engine cylinder 12 when the differential pressure injection valve 30 is open.

A connecting rod 160 is pivotally connected to the piston 26 adjacent one end and eccentrically and operably connected adjacent its opposite end to a crankshaft 162 of the compressor 24 which is journalled for rotation by bearings 164 and 168 in the crankcase 104 and block of the compressor 24. A cog pulley 166 is keyed to the crankshaft 162, for co-rotation therewith and is constructed to receive the power transmission belt or chain 28 associated with the cog pulley 86 of the engine cylinder 12 for co-rotation therewith. The pulleys 86, 166 preferably have the same effective diameter so that the piston 26 in the compressor 24 is driven at a 1:1 ratio with the piston 18 of the engine cylinder 12 to maintain synchronization of operation of the engine 10 and compressor 24 for each engine 10 cycle.

Rotation of the cog pulley 166 and crankshaft 162 of the compressor 24 causes linear reciprocation of the piston 26 within the cylinder 100 between top dead center 170 and bottom dead center 172 positions which varies the size of the compression chamber 134. The compression chamber 134 has its minimum volume when the piston 26 is at its top dead center position 170 and its maximum volume when the piston 26 is at its bottom dead center position 172. Correspondingly, the crankcase chamber 140 has its maximum volume when the piston 26 is at its top dead center position 170 and its minimum volume when the piston 26 is at its bottom dead center position 172. Currently preferred compressors have a displacement (the difference between the maximum and minimum compression chamber volume) between the range of 15% to 40% of the engine displacement and more preferably, between 20% and 30%. It has been found that compressor displacements smaller than 15% of the engine displacement do not provide sufficient quantities of fuel to the engine 10 under peak demand conditions resulting in poor engine performance. Compressor displacements larger than 40% of the engine displacement usually provide more fuel and air mixture than can be injected during the relatively short injection duration. Further, for optimum performance, the compressor crankcase chamber 140 compression ratio is about between 1.3 and 1.8. The compression of the fuel and air mixture within the compression chamber 134 is a function of the spring rate of the spring 128 biasing the compression relief valve 118 and the clearance between the cylinder head 108 and the piston 26 at its top dead center position 170, which is preferably about between 0.01 inch and 0.13 inch.

The carburetor 22 is constructed to deliver a rich fuel and air mixture, having sufficient fuel to satisfy the total fuel demand of the engine 10, to the intake port 110 of the compressor 24 which communicates with the crankcase chamber 140 of the compressor 24. Both conventional diaphragm carburetors such as disclosed in U.S. Pat. No. 4,271,093, and float bowl carburetors such as disclosed in U.S. Pat. No. 3,265,050 may be used, the disclosures of which are incorporated herein by reference and hence, the carburetor 22 will not be described in further detail. Induction of the fuel and air mixture into the crankcase chamber 140 is assisted by the sub-atmospheric or negative pressure created in the crankcase chamber 140 from the upward stroke of the piston 26 ascending towards its top dead center position 170 which draws fuel from the carburetor 22 into the compressor 24. Preferably, the fuel to air ratio of the mixture supplied to the compressor 24 is in the range of about 1:2 to 1:12.5 fuel to air thus providing a rich fuel to air mixture for pressurization which has a higher fuel to air content than desired for optimum combustion. Currently preferred fuel to air ratios for combustion are in the range of 1:12 to 1:18. To bring the fuel rich injected mixture into this range additional air is supplied to the combustion chamber 14 through the transfer port 94 when it is open. Injecting the rich fuel and air mixture is desirable because it allows a sufficient quantity of fuel to be injected over a short injection time which improves control over the injection event to improve fuel economy and reduce emissions from the engine 10. In addition, the rich fuel and air mixture is injected into the engine cylinder 12 adjacent the spark plug 44 and enhances initial ignition of the mixture and the additional air added from the crankcase 76 provides additional oxygen to the ignited mixture to facilitate its complete combustion.

The throttle valve 173 of the carburetor 22 may be operably associated with the engine air intake throttle valve 90 through a throttle linkage 174 so that the carburetor 22 meters the fuel and air mixture into the compressor 24 corresponding to and proportional to engine air flow conditions. To communicate the fuel and air mixture in the crankcase chamber 140 of the compressor 24 with its compression chamber 134, a transfer passage 176 is provided in the side wall 112 of the compressor 24 and when the piston 26 is adjacent its bottom dead center position 172 the ports 177 at the upper end of the transfer passage 176 are open to the compression chamber 134. The piston 26 movement towards its bottom dead center position 172 decreases the size of the crankcase chamber 140 and compresses the fuel therein such that when the transfer passage 176 is open to the compression chamber 134, the fuel and air mixture is forced therethrough. Also, with the compression relief valve 118 closed, the movement of the piston 26 towards its bottom dead center position 172 creates a pressure drop in the compression chamber 134 which tends to draw the mixture into the compression chamber 134 when the transfer passage 176 is open.

The axial location of the compressor intake ports 110 relative to the piston 26 is preferably such that the piston 26 initially opens the compressor intake ports 110 between 52.5° before top dead center (BTDC) and 32.5° BTDC in terms of compressor crankshaft 162 degrees of rotation. Correspondingly, the piston 26 fully closes the compression intake ports between 32.5° after top dead center (ATDC) and 52.5° ATDC in terms of compressor crankshaft rotation. Therefore, the period of open duration of the compression intake ports 110 is preferably between about 65° and 105° in terms of total compressor crankshaft 162 degrees of rotation. Similarly, the axial location of the ports 177 of the transfer passage 176 relative to the piston 26 is preferably such that the piston 26 initially opens the ports 177 between 140° ATDC to 155° ATDC in terms of compressor crankshaft degrees of rotation. The piston 26 correspondingly fully closes the ports 177 between 205° ATDC to 220° ATDC in terms of compressor crankshaft degrees of rotation. Thus, the open duration of the ports 177 to the compression chamber 134 is preferably between about 50° to 80° in terms of the total compressor crankshaft 162 degrees of rotation. These compressor intake port 110 and transfer passage 176 flow areas are desirably between 10% and 40%, and preferably 15% and 35% of the compressor cylinder bore 109 area where the compressor cylinder bore area is defined as $\pi$ times the square of the cylinder diameter divided by 4.

Figure 5:
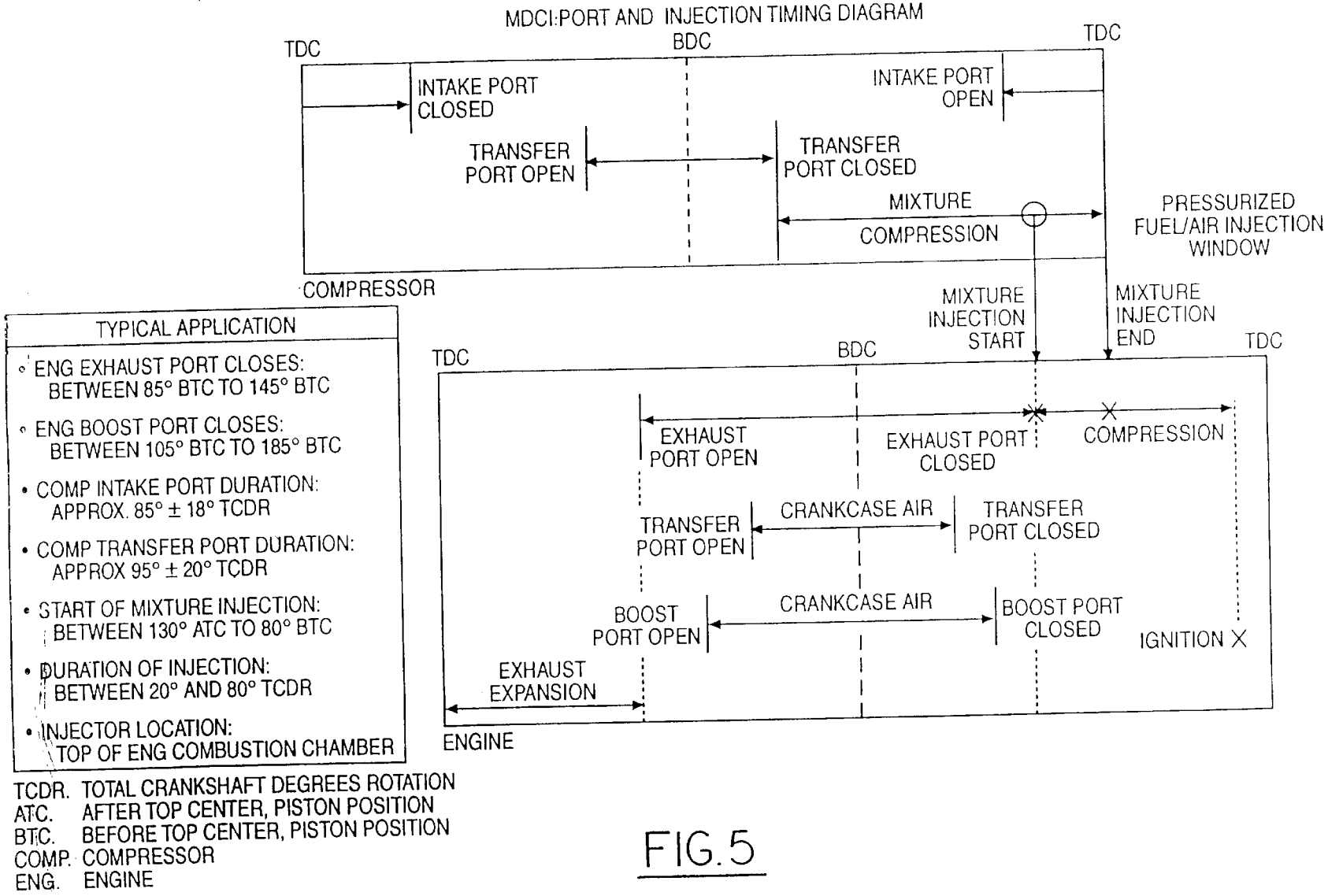
FIG. 5 is a chart illustrating the timing of the events in two strokes of the engine piston and compressor piston.

The timing for the start of injection of the rich fuel and air mixture into the combustion chamber 14, as referenced in FIG. 5, can range between about 130° of engine crankshaft 82 rotation after the piston 18 is at its top dead center position 34 (ATDC) to 60° of crankshaft rotation before the piston 18 reaches its top dead center position 34 (BTDC). The overall time duration of injection is dependent upon the mixture injection pressure, engine cylinder 12 pressure, and engine 10 speed. However, empirical data and calculations indicate average time for injection duration, in terms of angular crankshaft 82 rotation, to be as much as 80° at low engine speeds to as little as 20° at high engine speeds.

Figure 6:
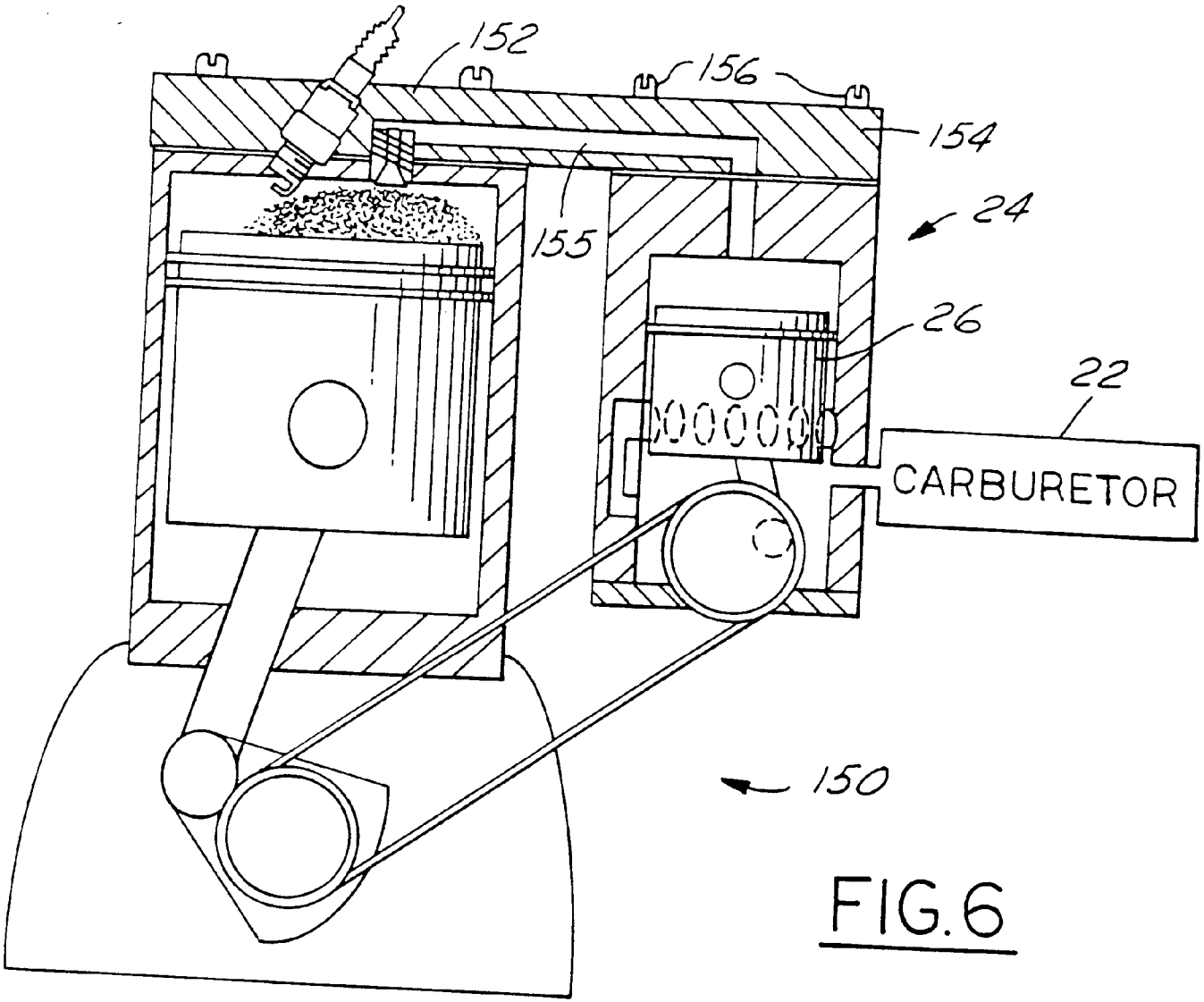
FIG. 6 illustrates an alternate embodiment of this invention wherein the compressor is connected to a modified cylinder head.

In an alternate embodiment 150, as shown in FIG. 6, a combined engine and compressor cylinder head 152 has an overhanging extension 154, with a passage 155 therein, to which the upper end of the compressor 24 and cylinder body 102 is connected by suitable bolts 156. In this embodiment, the cylinder head 152 can be readily fitted to current engine cylinders to readily adapt and operate the current engine according to this invention.

As also shown in FIG. 6, a differential pressure injection valve 30 may be used without a valve adjacent the compressor 24 to control both compression and injection of the mixture. Similarly, the system may have a valve adjacent the compressor without a valve adjacent the combustion chamber 14. Further other piston port designs or crankcase induction and carburization devices can be utilized in accordance with this invention for metering of the mixture into the compressor and subsequent pressurization of the mixture.

Figure 7:
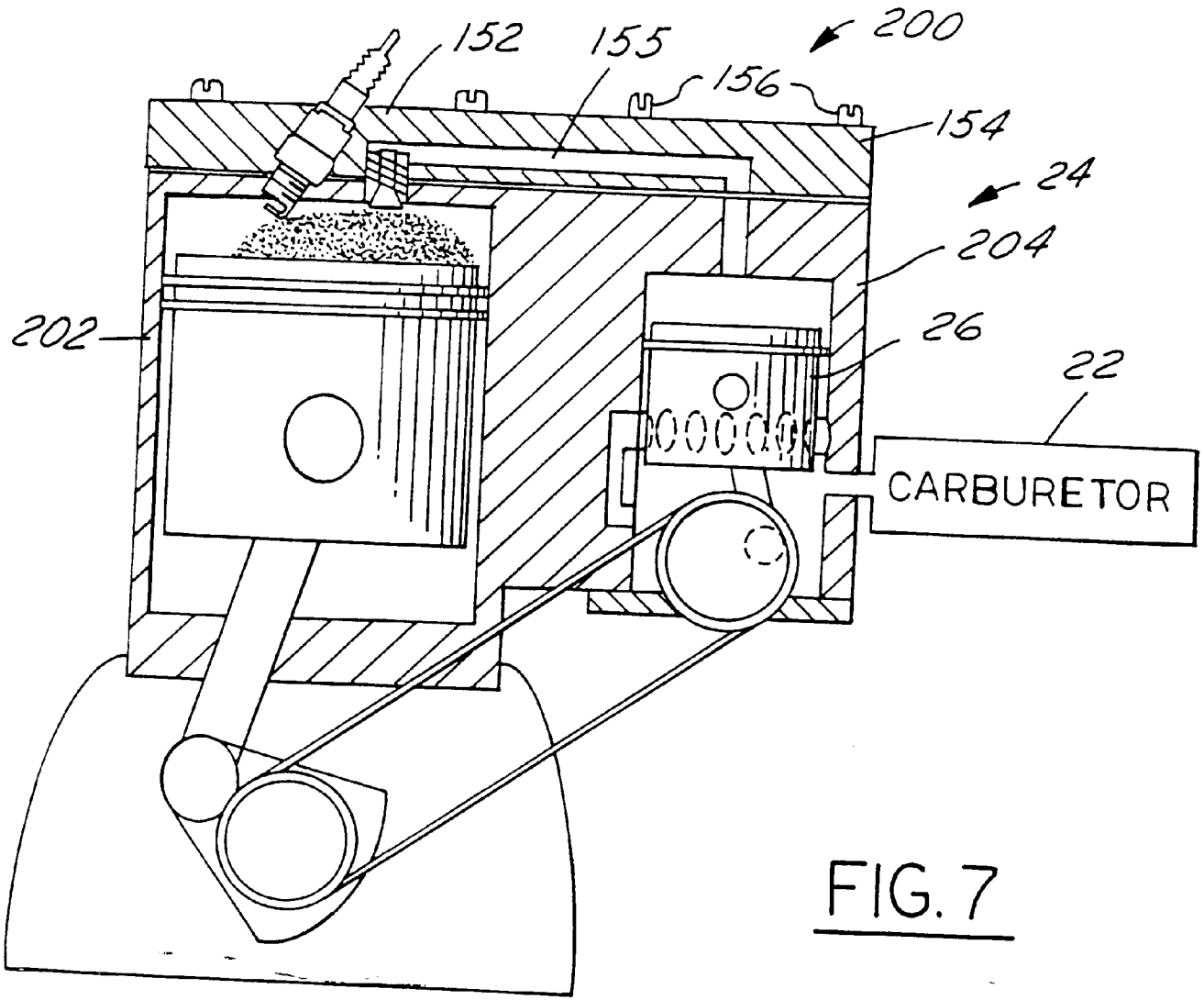
FIG. 7 illustrates another embodiment of this invention wherein the compressor body is integrally formed with the engine cylinder body and is connected to the modified cylinder head of FIG. 6.

Another embodiment 200 of this invention is shown in FIG. 7 and has an engine cylinder body 202 and compressor body 204 integrally formed such as by a one-piece casting. As in FIG. 6, a single cylinder head 152 may be used for both the engine cylinder 12 and compressor 24.

Operation

The general timing and relationship between events occurring in the compressor and the engine during two strokes of the piston of each are shown in FIG. 5. In use the engine air intake throttle valve 90 and the carburetor throttle valve are synchronized and typically moved together in unison between idle and wide open throttle positions in response to anticipated engine demand or load operating conditions. The valves 90 and 173 may be moved in unison by the throttle linkage 174 to simultaneously control and synchronize air flow into both the engine and the carburetor. Movement of the compressor piston 26 towards top dead center 170 creates a pressure drop in the crankcase chamber 140 and draws fuel therein through port 110 when open from the carburetor 22. The rich fuel and air mixture delivered to the crankcase chamber 140 of the compressor 24 is moved through its transfer passage 176 when its ports 177 are open and into the compression chamber 134 during movement of the piston 26 towards its bottom dead center position 172. During movement of the piston 26 towards its top dead center position 170 the piston 26 closes the ports 177 of the transfer passage 176 and compresses the rich fuel and air mixture within the compression chamber 134. When the fuel and air mixture within the compression chamber 134 is under pressure sufficient to disengage the valve head 126 of the compression relief valve 118 from its associated valve seat 130 the rich fuel and air mixture is displaced through the valve 118 and into the fluid conduit 52. When the pressure of the fuel and air mixture in the fluid conduit 52 is sufficiently greater than the pressure in the combustion chamber 14 and the force of the spring biasing the differential pressure injection valve 30, the valve head 64 of the differential pressure injection valve 30 is disengaged from its valve seat 68 and the fuel and air mixture is injected into the combustion chamber 14 of the engine cylinder 12. The overall time duration of the injection of the rich fuel and air mixture is dependent upon the injection pressure, engine cylinder pressure, and the speed of the engine and compressor. However, current calculations indicate the average time for injection, in terms of angular engine crankshaft rotation to be as much as 80° at low engine speeds and as little as 20° at high engine speeds.

As the piston 18 in the engine cylinder 12 travels toward its top dead center position 34 the volume of the combustion chamber 14 decreases and the piston 18 compresses and further mixes the fuel and air mixture in the combustion chamber 14. This also increases the pressure within the combustion chamber 14 until the pressure therein and the spring force biasing the differential pressure injection valve 30 are sufficient to close the valve 30 against the pressure of the fuel and air mixture in the conduit 52 to prevent further injection of the mixture into the combustion chamber 14 and to prevent reverse flow of the mixture into the conduit 52 during further compression and subsequent ignition of the mixture. Ignition of the mixture preferably occurs slightly before the piston 18 reaches its top dead center position 34 and the subsequent explosion from the ignition of the mixture drives the piston 18 toward its bottom dead center position 36. The downward movement of the piston 18 eventually opens the exhaust port 54 of the engine cylinder 12 allowing the exhaust gases of the burned mixture to escape through the exhaust port 54.

Movement of the piston 18 rotates the crankshaft 82 of the engine which in turn rotates the pulley 166 and crankshaft 162 of the compressor 24 by way of the power transmission timing belt or chain 28 received on each pulley 86, 166. Rotation of the crankshaft 162 of the compressor 24 causes its piston 26 to reciprocate and thereby draw the fuel and air mixture into the crankcase chamber 140 from the carburetor 28, transfer the fuel and air mixture from its crankcase chamber 140 to its compression chamber 134 and finally, compress and deliver the fuel and air mixture under pressure to the combustion chamber 14 of the engine cylinder 12.

Thus, the fuel and air mixture is mechanically metered and directly injected into the combustion chamber 14 within the engine cylinder 12 to power the engine 10. The compressor 24 is driven at a 1:1 ratio with the engine cylinder 12 to inject the fuel and air mixture during substantially the same portion of each cycle of the engine cylinder 12. The timing of the injection event can be readily changed by rotating one of the crankshafts 82, 162 relative to the other to change the portion of the cycle of the engine cylinder 12 in which the injection occurs. In practice this can be readily accomplished by rotating the crankcase body 104 about the axis of its crankshaft 162. Further, the injection event can be timed accurately to minimize the amount of injected fuel and air mixture which is lost with the exhaust scavenged gas. This greatly reduces the hydrocarbon emissions of the engine 10 and also greatly improves the fuel consumption of the engine 10. Still further, the system is of relatively low cost and is easily adaptable to current engine designs and most current engine applications.

We claim:

1. An engine comprising:

a two-stroke internal combustion engine having at least one cylinder;

a head for the engine cylinder;

an engine piston slidably received for linear reciprocation within each engine cylinder and defining a combustion chamber with the cylinder and its head and each engine cylinder and piston also defining in part a crankcase air chamber opposite the combustion chamber side of each engine piston, and a transfer passage in communication with the air chamber and selectively communicated with the combustion chamber to supply additional combustion air to the combustion chamber;

a spark plug communicating with each combustion chamber;

a crankshaft operably connected with each piston and powered to rotate in one direction by reciprocation of each piston;

a compressor having an inlet to receive a rich fuel and air mixture and an outlet to deliver the compressed rich fuel and air mixture under superatmospheric pressure of at least 30 PSI to each cylinder;

a carburetor having an outlet in communication with the inlet of the compressor to supply a rich fuel and air mixture to the compressor having a fuel to air ratio in the range of 1:2 to 1:12.5;

a valve in the head of each engine cylinder and communicating the outlet of the compressor with the interior of the engine cylinder, a spring yieldably biasing the valve to a closed position and the valve opening against the bias of the spring and in response to a pressure differential across the valve to admit a compressed rich fuel and air mixture into the engine cylinder, said engine cylinder communicating with said compressor outlet only through said valve; and a transmission member operably connecting the compressor with the crankshaft to drive the compressor in timed relation to each engine piston to compress and deliver the rich fuel and air mixture from the carburetor to the combustion chamber of each cylinder where it is ignited by a spark plug to power the engine.

2. The engine of claim 1 wherein the compressor comprises a secondary cylinder with a compressor piston slidably received for reciprocation therein to compress the rich fuel and air mixture and deliver the rich fuel and air mixture under pressure to the valve in the head of the combustion chamber of each cylinder.

3. The engine of claim 1 which also comprises a fluid conduit which communicates the outlet of the compressor with the valve in each cylinder head and having at least one secondary valve disposed adjacent to the compressor outlet to control flow of the fuel and air mixture through the fluid conduit.

4. The engine of claim 1 wherein the maximum diameter of the valve is between about 0.24 inch and 0.70 inch.

5. The engine of claim 4 wherein the maximum diameter of the valve, $D_v$, is in the range of 0.20 Bore Dia$<D_v<$0.35

Bore Dia, where Bore Dia is defined as the interior diameter of the engine cylinder.

6. The engine of claim 2 wherein the compressor piston of the secondary cylinder defines in part a compression chamber adjacent one side of the piston and a crankcase chamber adjacent its opposite side and the carburetor communicates with the crankcase chamber.

7. The engine of claim 6 which also comprises a transfer passage formed in the secondary cylinder and movement of the piston tending to decrease the volume of the crankcase chamber causes the fuel and air mixture therein to flow through the transfer passage and into the compression chamber.

8. The engine of claim 2 wherein the compressor piston is operably associated with a compressor crankshaft and the compressor crankshaft is driven by the transmission member such that reciprocation of the engine piston in the engine cylinder rotates the crankshaft which causes the transmission member to rotate the compressor crankshaft and thereby cause the compressor piston to reciprocate within and relative to the secondary cylinder.

9. The engine of claim 8 wherein the transmission member is a continuous loop of material operably associating the crankshaft with the compressor crankshaft.

10. The engine of claim 1 wherein the spring biasing the valve has a spring constant of about between 70 lb/in and 200 lbs/in.

11. The engine of claim 2 wherein the secondary cylinder is integrally formed with the cylinder.

12. The engine of claim 2 wherein the compressor piston of the secondary cylinder defines in part a compression chamber adjacent one side of the piston and the carburetor communicates with the compression chamber.

13. The engine of claim 3 wherein a pair of valves are disposed adjacent the conduit with one valve adjacent the cylinder and one adjacent the compressor.

14. The engine of claim 1 wherein each valve has a valve head and a valve stem and the valve head is exposed to the combustion chamber and constructed to engage a valve seat and prevent fluid flow through the opening and has a frusto conical shape to increase dispersion of the mixture when the valve is disengaged from the valve seat and the mixture flows through the opening, around the valve head and into the combustion chamber.

15. The engine of claim 6 wherein the compressor piston reciprocates between first and second positions defining the upper and lower limits of the path of travel of the piston and the outlet of the carburetor communicates with the cylinder at a point in between the first and second positions and the piston selectively communicates the outlet of the carburetor with the compression chamber.

16. The engine of claim 2 wherein the secondary cylinder is mounted exteriorly of the cylinder.

17. The engine of claim 8 which also comprises one pulley operably associated with each crankshaft for co-rotation and with each other through the transmission member.

18. The engine of claim 17 wherein the transmission member is a continuous belt looped around each pulley.

19. The engine of claim 17 wherein each pulley has the same effective diameter so that they rotate at the same speed.

20. The engine of claim 1 wherein the transmission member comprises a pair of cog pulleys and a loop of a timing member received on the cog pulleys and meshed therewith.

21. The engine of claim 1 wherein the displacement of the compressor is between 15% and 40% of the engine displacement.

22. The engine of claim 21 wherein the displacement of the compressor is between 20% and 30% of the engine displacement.

23. The engine of claim 13 wherein each valve is spring biased towards its fully closed position and the spring biasing the valve adjacent the cylinder has a spring constant of about between 70 lb/in and 200 lbs/in and the spring biasing the valve adjacent the compressor has a spring constant of about between 10 lbs/in to 30 lbs/in.

24. The engine of claim 1 wherein the rich fuel and air mixture is mixed with air in the engine cylinder to form a combustible mixture which is about 1:12 to 1:18 fuel to air.

25. The engine of claim 1 wherein the spark plug is inclined at an acute included angle of not more than about 45° relative to the axis of the engine cylinder.

26. The engine of claim 1 wherein the fuel and air mixture delivery to the cylinder begins, in terms of degrees of engine crankshaft rotation, between about 130° after it reaches top dead center of the engine piston to about 60° before top dead center of the engine piston.

27. The engine of claim 1 wherein the compressor delivers the fuel and air mixture to each cylinder at a pressure in the range of about between 30 psi and 160 psi.

28. The engine of claim 1 wherein the carburetor delivers the total fuel demand of the engine.

29. An engine comprising:

a two-stroke internal combustion engine having a cylinder and a cylinder head;

an engine piston slidably received for linear reciprocation within the cylinder and defining a combustion chamber with the cylinder and head, each engine cylinder and piston defining in part an air chamber opposite the combustion chamber side of each engine piston and its engine cylinder, a transfer passage in communication with the air chamber and selectively communicated with the combustion chamber to supply additional combustion air to the combustion chamber;

a spark plug communicating with the combustion chamber;

a crankshaft operably connected with the piston and powered to rotate in one direction by reciprocation of the piston;

a compressor having a compressor piston slidably received in a secondary cylinder and defining in part a compression chamber adjacent one side of the compressor piston and a crankcase chamber adjacent its opposite side, an inlet to the crankcase chamber to receive a rich fuel and air mixture and an outlet from the compression chamber to deliver the rich fuel and air mixture under a pressure of at least 30 PSI to the engine cylinder;

a carburetor having an outlet in communication with the inlet of the compressor to supply a rich fuel and air mixture to the compressor having a fuel to air ratio in the range of 1:2 to 1:12.5;

a transfer passage formed in the secondary cylinder so that movement of the compressor piston tending to decrease the volume of the crankcase chamber causes the rich fuel and air mixture therein to flow through the transfer passage and into the compression chamber;

a valve in the engine head and communicating the outlet of the compressor with the interior of the engine cylinder, a spring yieldably biasing the valve to a closed position and the valve opening against the bias of the spring and in response to a pressure differential across the valve to admit a compressed rich fuel and air mixture into the engine cylinder, said engine cylinder communicating with said compressor outlet only through said valve; and a transmission member operably connecting the compressor with the crankshaft to drive the compressor piston in timed relation to the engine piston to compress and deliver the rich fuel and air mixture from the carburetor to the combustion chamber of the engine cylinder where it is ignited by the spark plug to power the engine.

* * * * *

UNITED STATES PATENT AND TRADEMARK OFFICE

CERTIFICATE OF CORRECTION

PATENT NO. : 6,026,769
DATED : February 22, 2000
INVENTOR(S) : Muniappan Anbarasu et al.

It is certified that error appears in the above-identified patent and that said Letters Patent is hereby corrected as shown below:

Title page,
Item [75] Inventors: Muniappan Anbarasu, Flint; William E. Galka, Caro; Martin L. Radue; Ronald H. Roche, both of Cass City; Kevin L. Williams, Columbiaville; Charles H. Tuckey, Cass City; J. D. Tuckey, deceased, late of Cass City, all of Mich., by Jay D. Tuckey and Barbara Doerr as co-successor trustees of J. D. Tuckey Trust Signed and Sealed this Twenty-eighth Day of May, 2002

*Attest:*

*Attesting Officer*

JAMES E. ROGAN
*Director of the United States Patent and Trademark Office*